United States Patent [19]

Thomson

[11] 4,212,547

[45] Jul. 15, 1980

[54] APPARATUS FOR BLENDING FLUID AND SOFT PARTICULATE FOOD CONSTITUENTS

[75] Inventor: Meredith C. Thomson, Sheboygan, Wis.

[73] Assignee: Stoelting, Inc., Kiel, Wis.

[21] Appl. No.: 21,514

[22] Filed: Mar. 19, 1979

[51] Int. Cl.[2] ..... B01F 7/08; B01F 7/04

[52] U.S. Cl. ..... 366/325; 366/141

[58] Field of Search ..... 366/325, 329, 327, 320, 366/64, 141, 142; 99/452, 456, 458, 459, 460, 461

[56] References Cited

U.S. PATENT DOCUMENTS

| | | | |
|---|---|---|---|
| 1,253,543 | 1/1918 | Stokes | 366/325 |
| 2,217,318 | 10/1940 | Nanna | 366/329 |
| 3,570,569 | 3/1971 | Hartley | 366/325 |
| 3,645,813 | 2/1972 | Funke | 366/325 |

*Primary Examiner*—Robert W. Jenkins

*Attorney, Agent, or Firm*—Wheeler, Morsell, House & Fuller

[57] ABSTRACT

Apparatus for blending materials having different consistencies such as a cream dressing and cottage cheese curd. A cylindrical container having a flat bottom is supported with its central axis at an angle of 30° to 60° but usually preferably about 45° from horizontal and vertical. A motor driven shaft extends from the top toward the bottom of the cylinder with its axis parallel to the central cylinder axis but offset into the half of the cylinder which lies below its axis. The shaft carries upper and lower flat mixing blades which are nominally 180° apart and are axially spaced and the opposite blades are at such angles relative to the shaft axis that the blades swing through a range of angles between vertical and horizontal as they orbit about the shaft axis.

16 Claims, 9 Drawing Figures

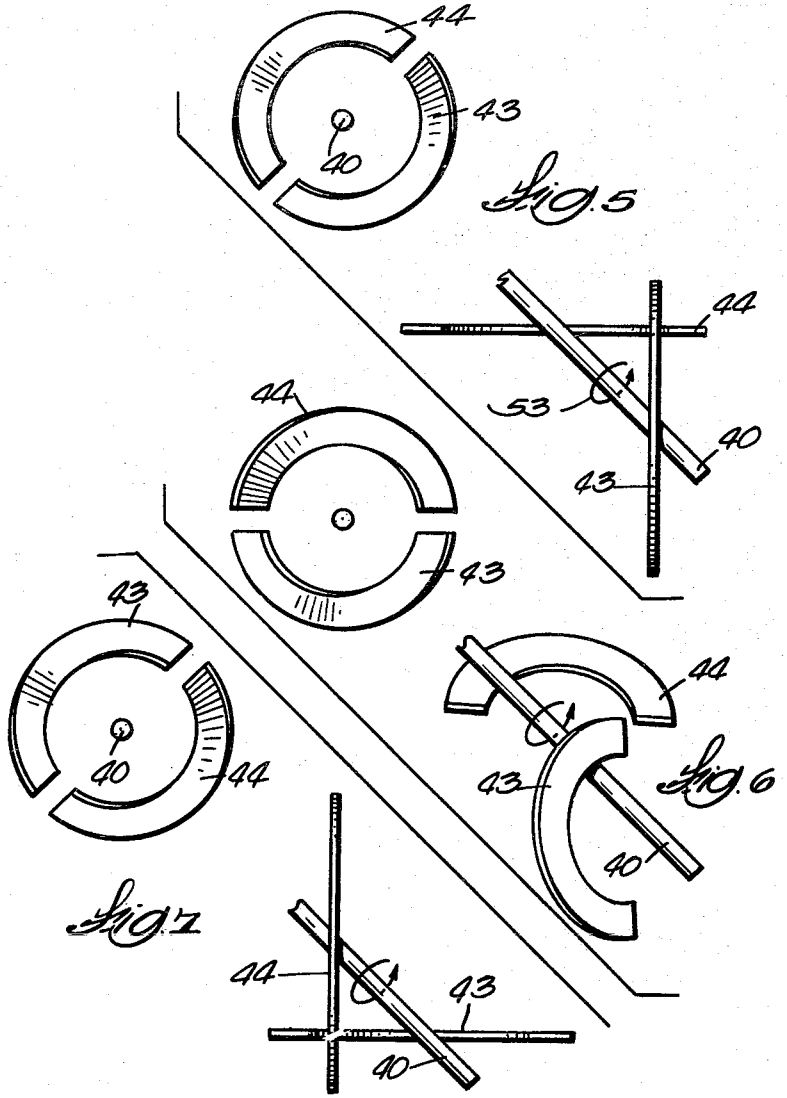
44
43
40
Fig. 5
44
40
53
43
44
43
44
43
Fig. 6
40
43
44
40
43
44
40
Fig. 7
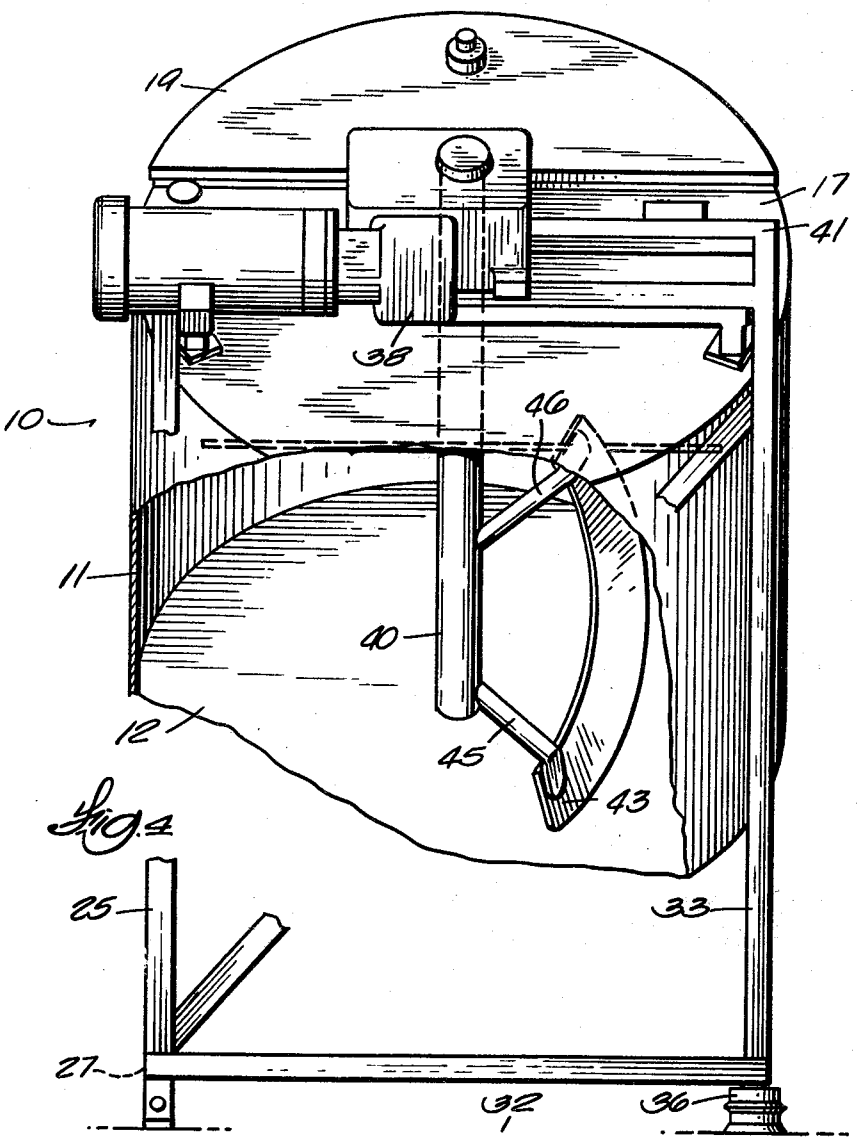
17
41
14
38
46
43
45
40
33
36
32
12
11
10
25
27
Fig. 4

9 — 9

APPARATUS FOR BLENDING FLUID AND SOFT PARTICULATE FOOD CONSTITUENTS

This invention pertains to apparatus for blending fluid and soft particulate solid food constituents such as cream dressing and cottage cheese curd.

One of the steps involved in making cottage cheese is to extract most of the free water from a mixture of cottage cheese curd and water so as to yield a mass of nominally dried curd. The curd at this point in the process is composed of essentially discrete or uncoalesced particles. The next step which is usually performed is to cream the cottage cheese curd which means that a creamy dressing is mixed with it to form a coating on the curd particles, hopfully without inducing coalescence which would result in the mixture becoming an essentially homogeneous mass. This is undesirable for the type of cottage cheese under consideration. Hence, it becomes important to carry out the creaming step soon after the curd is de-watered and it is important to do this rapidly without subjecting the cream dressing and curd mixture to anything but gentle mixing forces.

SUMMARY OF THE INVENTION

A general object of the present invention is to provide blender apparatus which will blend a batch of food constituents such as cream dressing and cottage cheese curd in a shorter time than with blender apparatus used heretofore and without causing any substantial breakdown of the curd particle size and shape and without inducing significant coalescence.

The new blender is characterized by a wall defining a hollow cylinder which has a closed bottom. In the illustrated embodiment, the cylinder is supported with its central axis at an angle of 45°, with respect to vertical and horizontal. A motor driven shaft extends from the top toward the bottom of the cylindrical container and has its axis preferably parallel with and radially displaced from the central axis of the cylinder. The shaft and its axis are thus disposed in the lower half of the cylinder below its axis. At least a pair of flat mixing blades are mounted in radially extending relation to the shaft for orbiting around the shaft axis. The blades are axially separated and arranged on diametrically opposite sides of the shaft. The blades are disposed at an angle with respect to the shaft axis which, in the preferred embodiment, corresponds with the angle to which the shaft and cylinder axis are tilted from vertical. As the blades orbit around the shaft when the latter is rotated, they each go through a range of angles between vertical and horizontal which results in the product being subjected to a gentle folding action that involves lifting the product along the outer area or lower half of the cylinder to its top and then inducing downward movement along the opposite side back to the lower center area.

The manner in which the foregoing advantages, objects and results are achieved and the achievement of other more specific objects will be evident in the ensuing more detailed description of a preferred embodiment of the invention which will now be set forth in reference to the drawings.

DESCRIPTION OF THE DRAWINGS

FIG. 1 is a side elevation view of the blender apparatus in which a wall portion is broken away to show the machine elements which are inside of the cylinder;

FIGS. 5, 6 and 7 are a succession of diagrammatic views for describing and explaining the action and cooperation of the mixer blades during operation of the apparatus;

DESCRIPTION OF A PREFERRED EMBODIMENT

Figure 3:
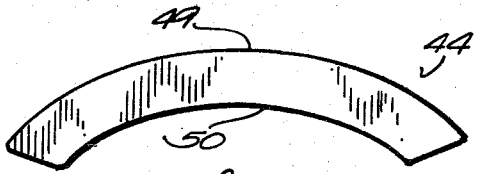
FIG. 3 is a plan view of one of the mixing blades as viewed in the direction of the arrows 3—3 in FIG. 1.

Referring to FIG. 1, the blender apparatus comprises a hollow cylindrical container 10 including a sheet metal wall and a planar bottom closure 12. The wall and bottom material is preferably stainless steel. The central axis of the cylinder is represented by the dash-dot line 13. This axis and, hence, the wall of the cylinder are held at an angle of 45°, preferably with respect to imaginary vertical and horizontal lines which intersect with the axis at a common point and are in the same plane as the cylinder axis. Having the cylinder axis at 45° results in the container bottom being angulated at a corresponding angle of 45° on the side opposite of vertical from the cylinder axis. As is the case in this illustrative embodiment, when the cylinder wall 11 and bottom 12 are at equal angles with respect to horizontal, a creamed cottage cheese mixture in contact with the cylinder wall and bottom is equally influenced by gravity to flow toward the presently closed outlet port 14 when it is desired to discharge the finished batch of curd and creamy dressing through the port. Use of the apparatus has demonstrated that creamed cottage cheese curd will flow satisfactorily along a smooth surface which is inclined at 45°. However, a lesser angle for one of the cylinder walls or the bottom at the expense of the angle of the other could be tolerated for some products which are more or less viscous. Some of the benefits of the new combination of structural and functional features which characterize the new blender apparatus and which will be described later, can be achieved when the cylinder axis is anywhere from 30° to 60° with respect to horizontal or, in other words, plus or minus 15° from the illustrated 45° which is meritorious in a cottage cheese blender.

As viewed in FIG. 1, one semi-cylindrical half 15 of cylinder 10 may be looked upon as being below cylinder axis 13 and the other half 16 as being above the cylinder axis. The lower sidewall 11 may be looked upon as forming a V-shaped cavity in conjunction with intersecting bottom wall 12 of the cylinder. Thus, the outlet 14 is near or at the apex of the V. Vertically upward from the apex, at the top 17 of the cylinder there is a constituent input port 18 which is provided with a removable or hinged cover 19. When using the apparatus to cream cottage cheese curd, it is recommended that the desired amount of liquid cream dressing be put in the cylinder first and then the de-watered cottage cheese curd should be put in. A suggested appropriate level for a batch is indicated by the horizontal level line 20. This leaves a clear volume 21 above the batch so it can rise and fall during the blending process without impinging on inlet port cover 19.

Figure 4:
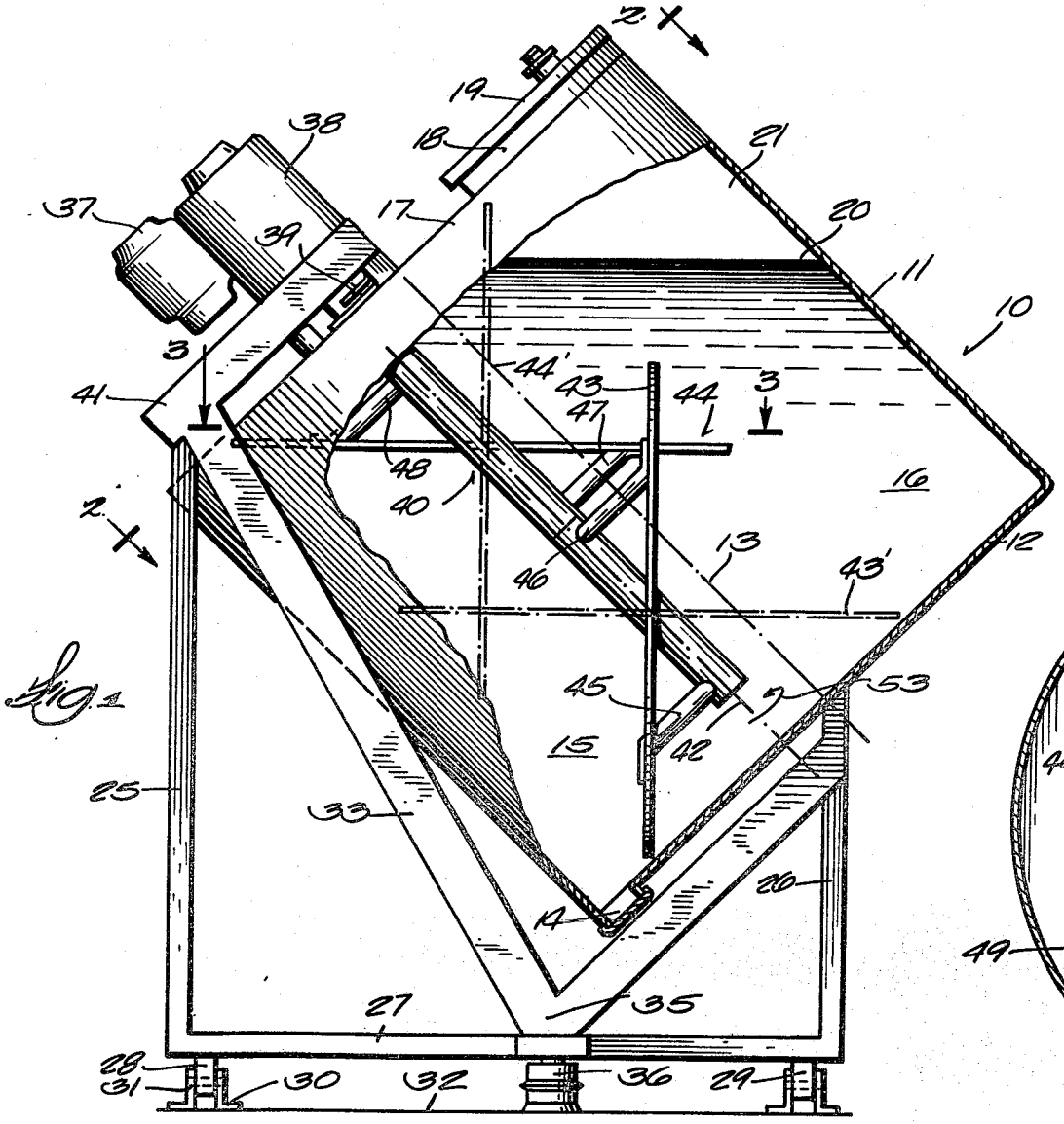
FIG. 4 is a front view of the apparatus shown in FIG. 3 with part of the cylindrical container and parts of the container support being broken away for the sake of clarity.

Cylindrical container 10 is supported on a frame which, by viewing FIGS. 1 and 4, can be seen to comprise longitudinally spaced apart upstanding members 25 and 26 which are joined together at their bottom ends by a longitudinally extending member 27 as can be seen in FIG. 1. Member 27 has a pair of similar lugs 28 and 29 fastened to its bottom. Taking lug 28 for example, it fits between a pair of angle brackets 30 and is engaged to the brackets with a pin 31 to thereby form a pivotal connection. The line 32 may be considered to be the planar top surface of a skid, which is not completely shown, but is used where it is desired to allow for locating the apparatus at any selected location in a plant. Line 32 may also be considered the top of a floor surface to which the angles 30 are permanently affixed when the apparatus is to be installed at a permanent location.

The side of the cylindrical container supporting frame nearest to the observer in FIG. 1 includes a pair of members 33 and 34 which are joined at the apex 35 of a V-shaped or single point support configuration. The apex 35 bears on a load sensitive cell 36 and constitutes the only support for the assembly on one side of the frame. Load cell 36 could be a piezoelectric type but, in the commercial embodiment, a hydraulic type was selected. The load cell produces pressure signals which are sensed by means, not shown, to provide an indication of the weight of the apparatus. Because of the pivotal connection on one side of the supporting frame, the reactive force on the load cell will be proportional to about one-half of the weight of the apparatus. Thus, it should be evident that the weights of the constituents of a batch may be easily determined by subtracting the weight of the apparatus when loaded from the weight of the apparatus when it is unloaded. The single point support and pivot system for the frame, of course, has the advantage of enabling the weight of the constituents to be determined with a single load cell as opposed to the plurality of cells which are customarily used in arrangements of this type.

Mixing of the food constituents in cylindrical container 11 is accomplished with a motor 37 that is coupled to a speed reducer 38 whose output shaft 39 is coupled to and is coaxial with a mixer or agitator shaft 40. Motor 37 and speed reducer 38 are mounted to a part 41 of the frame which extends over the top 17 of the cylindrical container.

The axis 42 of shaft 40 is parallel to cylinder axis 13 and the shaft axis is offset from the cylinder axis into the lower half of the cylinder as is evident from inspection of FIG. 1. One may see in FIG. 4 that shaft 40 is on the center line of the cylinder when viewed from an end of the cylinder.

In the illustrated preferred embodiment, there are only two agitator blades 43 and 44 mounted to shaft 40. Typical of both blades, the lowermost blade 43 is supported from shaft 40 with a pair of generally radially extending struts 45 and 46. The upper blade 44 is supported with struts 47 and 48. The struts, blades and shaft are preferably made of corrosion resistant metal.

A typical blade 44, shown in FIG. 3, is basically a planar metal strip constituting a segment of a curve which has a convex edge 49 and a concave edge 50. The struts have been omitted from FIG. 3.

Figure 2:
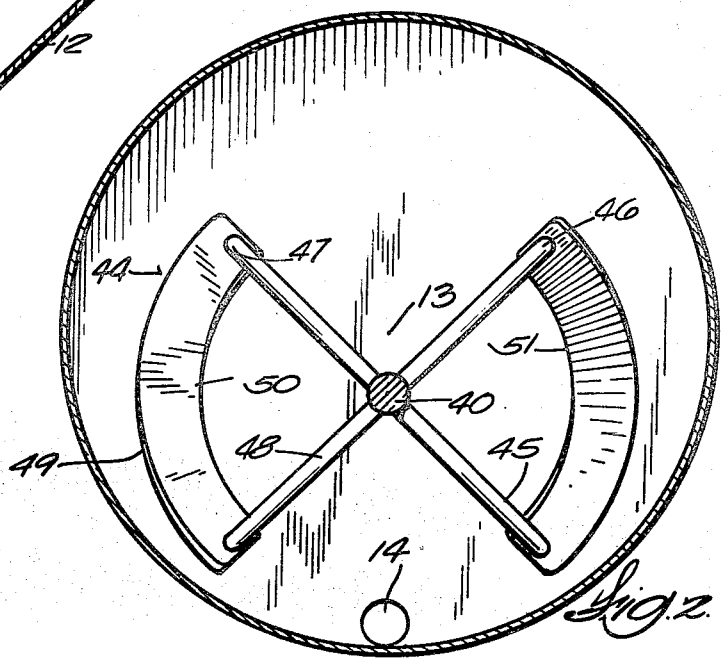
FIG. 2 is a top end view looking in the direction of the arrows 2—2 in FIG. 1.

As can be seen in FIG. 2, blades 43 and 44 are located on diametrically opposite sides of shaft 40 and they extend over nearly 180° circumferentially although there is a small gap 51 between. However, the blades could overlap slightly in the circumferential direction if desired. Because the agitator blades 43 and 44 are radially spaced from the shaft 40 by the struts, the blades may be looked upon as being capable of following an orbital path around the shaft axis when the shaft is rotated under the influence of motor 37.

As shown in FIG. 1, the plane of blades 43 and 44 are inclined at similar angles relative to the axis of shaft 40. Blade 43 is shown at a point in its orbital or rotational movement at which it is disposed vertically at the moment and blade 44 is horizontal at the moment. Both blades are actually pitched in the same direction and it will be evident that in executing their orbital movement they must necessarily oscillate through a range of angles between horizontal and vertical. For instance, when upper blade 44 in FIG. 1 has rotated another 180° counterclockwise as viewed from the lower end of the shaft and indicated by the circular arrowheaded line 53, blade 44 will have reached its vertical attitude as indicated by its phantom line representation marked 44'. At that time, lower blade 43 will be disposed in a horizontal attitude as indicated by its phantom line representation marked 43'. The angles of the blades relative to a plane to which the axis 42 of the shaft 40 is perpendicular is preferably equal to the angle which the axes 42 and 13 of the shaft and cylinder, respectively, make with a horizontal plane. Thus, in the preferred embodiment, where the shaft axis 42 and cylinder axis 13 are at a nominal 45° from horizontal, blades 43 and 44 will be at an angle of 45° relative to the shaft axis.

Execution of a full orbital cycle by the blades is demonstrated by the sequence of diagrams in FIGS. 5, 6 and 7. In the left portions of these figures, the plan views of blades 43 and 44 are shown as viewed from the upper end of shaft 40. The downwardly angulated right portion of these figures shows the blades in the different positions which they assume relative to horizontal and vertical during the course of a complete orbit. In FIG. 5, blade 43, nearest to the observer, has reached full vertical attitude and blade 44, on the other side of the shaft 40 farthest from the observer has reached its horizontal attitude. The orientation of the blades in FIG. 5 corresponds with their orientation in FIG. 1. In FIG. 6, blades 43 and 44 have been rotated 45° beyond their FIG. 5 positions and it will be evident in the right portion of FIG. 6 that lower blade 43 is now sweeping down at an angle with respect to the foremost semicircular wall portion of the cylinder at an angle with respect to vertical. Blade 43 is now going into an attitude for effecting a lifting action on the food constituent mixture so as to raise the mixture upwardly toward blade 44 which is now clearing out of the lower half of the cylinder so as to not interfere with this action. Prior to this moment, upper blade 44 has been assisting in the lifting action resulting from the previous orbit of lower blade 43. It will be evident then that the two blades cooperate to raise the mixture in the lower half of cylinder 10 and urge it over to the upper half where it can circulate back to the lower region of the cylinder 10 for further agitation by the blades. FIG. 7 shows completion of the cycle in which case blade 43 is farther from the observer and horizontal and blade 44 is nearer to the observer and vertical. As rotation of the shaft continues blade 44 will orbit around to the opposite side of shaft 40 and again attain its horizontal attitude as depicted in FIG. 5 and the cycle repeats.

As shown in FIG. 2, the displacement of the axis of shaft 40 with respect to cylinder axis 13, that is, the eccentricity of the shaft axis in one plane relative to the cylinder annulus, permits the blades to oscillate close to and farther from the cylinder wall surface which defines the lower semicircular part of the cylinder 15 lying below its axis 13. Observe also that when the lower blade is sweeping through the lower half of the cylinder its lower edge first sweeps along the bottom 12 of the cylinder when the blade is mainly vertical and then continues around toward horizontal at which time the edge of the blade sweeps rather closely to the wall of the cylinder such as to assure that practically all of the mixture on the lower side of the cylinder will be subject to lifting agitation during each orbital cycle of the blade. Note also that, by having the axis 40 of the shaft offset from the axis 13 of the cylindrical container, the top blade may have a substantial pitch or angulation which allows opposed ends of the blade to approach the top 17 and sidewall of the cylinder closely but without the blade ever passing the inlet port 18 which might otherwise be a possible hazard to human hands if the machine were operated without cover 19 being closed.

By way of example and not limitation, one commercial model of the new blender apparatus uses a cylindrical container having an inside diameter of about 54 inches or a radius of 27 inches and an axial length of about 52 inches. The blades are about four inches wide and the outer radius 49 of the blades is about 21½ inches. The shaft axis 41 is offset about five inches from the cylinder axis 13. The end of the lower blade clears the cylinder bottom by about one-half inch. The outer edge of each blade sweeps within about one-half inch of the lower cylinder sidewall and the blades clear the upper sidewall by about ten inches. The container has a capacity for about 4,000 pounds of cream dressing and curd. A variable speed motor is used for driving the agitator shaft at a rotational speed in the range of 0 to 10 rpm in a commercial embodiment. By way of example and not limitation, a speed of about 2 rpm has been found to be desirable for a particular cottage cheese product.

Figure 9:
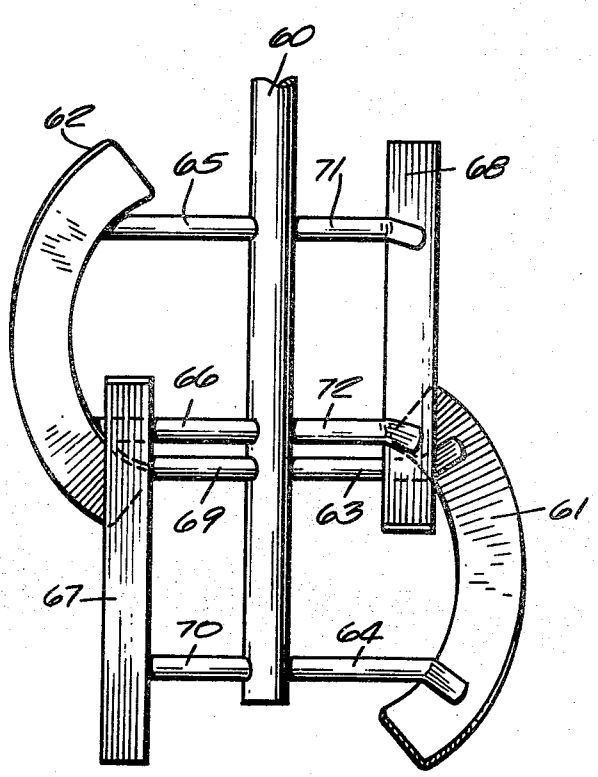
FIG. 9 is a view of the agitator rotated 90° from its FIG. 8 position as it would appear when looking in the direction of the arrows 9—9 in FIG. 8.
Figure 8:
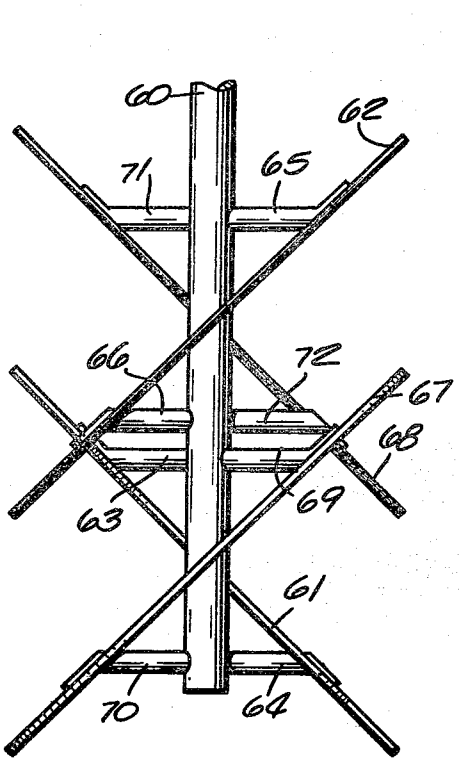
FIG. 8 is a side view of an alternative embodiment of an agitator assembly isolated from the container in which it operates.

FIGS. 8 and 9 depict an alternate form of agitator which may be used in the container 10 in place of the agitator which is shown in the FIG. 1–7 embodiment of the blender. This agitator assembly comprises a shaft 60 which is comparable to shaft 40 in the described embodiment. Shaft 60 should be considered as being disposed at an angle relative to horizontal with its axis parallel to but offset from the axis of cylinder 10 as in the previous embodiment.

There are a pair of curved primary blades 61 and 62 mounted to shaft 60 by pairs of struts 63, 64 and 65, 66, respectively, as in the previous embodiment. Blades 61 and 62 are also basically on diametrically opposite sides of shaft 60 and they are angulated relative to each other and to the shaft similar to their counterparts 43 and 44 in FIGS. 1–7. Their location relative to the bottom half of cylinder 10 and their operating mode is also basically the same as their counterparts.

In the FIGS. 8 and 9 embodiment, a pair of secondary blades 67 and 68 have been added. Blade 67 is mounted to shaft 60 with a pair of struts 69, 70 and blade 68 with a pair of struts 71 and 72. Secondary blades 67 and 68 may be straight and flat as shown and preferably but not necessarily at an angle to the axis of shaft 60 similar to the curved blades 61 and 62 to which are, respectively, diametrically opposite from secondary blades 67 and 68. Blades 67 and 68 are on shorter struts so their radial distances from the shaft axis are less than that of curved blades 61 and 62 so blades 67 and 68 have an orbital path which is inside the orbital path of curved blades 61 and 62, respectively.

In this arrangement, orbiting blades 67 and 68 augment the lifting action on materials near the shaft which might otherwise become slightly immobilized within the orbit of the outer curved blades 61 and 62 when compositions of certain consistencies are being blended. A lower straight blade 67, for example, tends to force material gently upwardly into the path of upper curved blade 62 when these blades are in the lower half of the cylindrical container while at the same time the other upper secondary blade 68 is assisting in forcing material, which has been moved to the upper half of the cylinder, downwardly into the path of lower curved blade 61 to thereby enhance mixing and circulation of all the material in the blender.

Although the blender which has been described heretofore in considerable detail has been discovered to cream a batch of cottage cheese in the shortest possible time with minimum damage being done to the discrete curds, some modifications could be made to adapt the machine more particularly to blending other food substances. For instance, the tilt angle of the cylinder could be altered somewhat such as in contemplation of dealing with food substances that will slide down toward the bottom outlet port 14 even though one or the other of the cylinder sidewall or bottom are at unequal angles with respect to vertical. Some models made in connection with testing the feasibility of the basic concepts of the new blender had the upper blade disposed at an equal but opposite angle with respect to the shaft axis than the angle at which the lower blade was disposed. It was determined, however, that the most efficient mixing and agitation action, consistent with the action described earlier, was obtained when the blades on the opposite side of the shaft were at similar angles.

Although a preferred embodiment of the new blender has been described in detail, such description is intended to be illustrative rather than limiting, for the invention may be variously embodied and is to be limited only by interpretation of the claims which follow.

I claim:

1. Blender apparatus for blending fluid and soft particulate food constituents, said blender comprising:

a wall defining a hollow cylinder and means for closing the bottom end of said cylinder to form a container for said fluid and particulate constituents, means for supporting said cylinder with its axis at an angle in the range between 30° to 60° with respect to horizontal whereby half of said cylinder will be above and the other half will be below said axis, a rotatable shaft projecting into said container toward its bottom, the axis of said shaft being in substantial parallelism with the axis of the cylinder, first and second blade means mounted to said shaft and projecting radially away from said shaft for orbiting about said shaft axis, said blade means being angulated in the same direction and being axially spaced apart and located on generally opposite sides of the shaft axis and being disposed in planes, respectively, which intersect said shaft axis at angles other than right angles, the angles of said oppositely located blades relative to said shaft axis being such that during rotation of said shaft said blades will oscillate, respectively, from the nearest to horizontal altitude which they can attain on one side of said axis to the nearest to vertical altitude which they can attain on the other side of said axis such that when one blade is nearest to horizontal the other blade will simultaneously be nearest to vertical, said first blade means being nearer to the bottom of said container than second blade means.

2. The blender as claimed in claim 1 wherein said shaft axis is displaced from said cylinder axis toward the side of said cylinder which is below its axis and the axial length of said cylinder is about equal to its diameter.

3. The blender as claimed in claim 1 wherein the shaft axis is displaced radially from said cylinder axis toward the side of said cylinder which is below its axis such that during rotation of said shaft said blades will make a closer approach to the side of said cylinder which is below than to the side of said cylinder which is above said axis.

4. The blender as claimed in claim 1 wherein said blades are flat strips which are radially displaced from said shaft.

5. The blender as claimed in claim 1 wherein said blades are comprised of flat strips which are curved in the circumferential direction, said strips having circumferentially spaced apart ends and radially spaced apart curved inner and outer edges.

6. The blender as claimed in claim 1 wherein said blades are comprised of flat strips having circumferentially spaced apart leading and trailing ends and concave and convex inner and outer edges, the concave inner edge being near to said shaft axis than the convex outer edge.

7. The apparatus as claimed in any of claims 1, 2, 3, 4, 5 or 6 wherein the axis of said cylinder is at an angle of substantially 45° from horizontal.

8. The apparatus as claimed in any of claims 1, 2, 3, 4, 5 or 6 wherein the axis of said cylinder and the axis of said shaft are at an angle of substantially 45° from horizontal and said blades are disposed in planes which intersect said shaft axis at an angle of substantially 45°.

9. The apparatus as claimed in any of claims 1, 2, 3, 4, 5 or 6 including:

a pair of secondary blades mounted to said shaft and projecting away from said shaft, one of said secondary blades being generally opposite from said first blade and the other being generally opposite from said second blades, said secondary blades being at a lesser radial distance from said shaft than said first and second blades and being disposed in planes which are intersected by said shaft axis at angles other than right angles.

10. Apparatus for blending fluid and soft particulate food constituents such as a creamy substance and a mass of cottage cheese curd, said apparatus comprising:

a wall defining a hollow cylinder and a generally planar bottom member closing the lower end of said cylinder to form a container for said constituents, a rotatably driven shaft projecting into said cylinder with the shaft axis in substantial parallelism with the axis of said cylinder and in substantial perpendicularity to said bottom member, means for supporting said cylinder with its axis disposed at an angle in the range between 30° and 60° with respect to horizontal whereby half of said cylinder will be above and the other half will be below cylinder axis, first and second blade means mounted to the shaft and projecting radially away from said shaft for orbiting about said shaft axis when said shaft is rotated, said first blade means being nearer to the bottom of said cylinder than said second blade means, said first and second blade means being disposed on generally opposite sides of said shaft and each being at an angle and angulated in the same direction relative to the shaft axis, at least said first blade means being disposed at an angle relative to said shaft axis corresponding with the angle between said shaft axis and vertical to cause said first blade means to pass through a range of angles relative to horizontal during the part of its orbit in the lower half of said cylinder and to be disposed horizontally at the end of said range, the angles of said oppositely located blades relative to said shaft axis being such that during rotation of said shaft said blades will oscillate, respectively, from the nearest to horizontal altitude which they can attain on one side of said axis to the nearest to vertical altitude which they can attain on the other side of said axis such that when one blade is nearest to horizontal the other blade will simultaneously be nearest to vertical.

11. The apparatus as claimed in claim 10 wherein said first and second blade means comprise generally flat blade members, the angles of the first and second blade members relative to said shaft axis being equal.

12. The apparatus as claimed in claim 10 wherein said first and second blade means comprise generally flat blade members, the angle of said members relative to said shaft axis and the angles of said cylinder and shaft axes, respectively, relative to horizontal all being angles of about 45°.

13. The apparatus as claimed in claims 11 or 12 wherein said flat blade members comprise segments of an annulus which are radially spaced from said shaft and are concave on a side nearer to the shaft and convex on a side farther from the shaft.

14. The apparatus as claimed in any one of claims 10, 11, 12 or 13 wherein said shaft is displaced from said cylinder axis and is in the lower half of said cylinder to enable said blades to come closer to the wall defining the lower half of said cylinder than to the wall defining the upper half of said cylinder.

15. Apparatus for blending fluid and soft particulate food constituents such as a creamy substance and a mass of cottage cheese curd, said apparatus comprising:

a wall defining a hollow cylinder and a generally planar bottom member closing the lower end of said cylinder to form a container for said constituents, a rotatably driven shaft projecting into said cylinder with the shaft axis in substantial parallelism with the axis of said cylinder and in substantial perpendicularity to said bottom member, means for supporting said cylinder with its axis disposed at an angle in the range between 30° and 60° with respect to horizontal whereby half of said cylinder will be above and the other half will be below cylinder axis, first and second blade means mounted to the shaft and projecting radially away from said shaft for orbiting about said shaft axis when said shaft is rotated, said first blade means being nearer to the bottom of said cylinder than said second blade means, said first and second blade means being disposed on generally opposite sides of said shaft and each being at an angle and angulated in the same direction relative to the shaft axis, at least said first blade means being disposed at an angle relative to said shaft axis corresponding with the angle between said shaft axis and vertical to cause said first blade means to pass through a range of angles relative to horizontal during the part of its orbit in the lower half of said cylinder and to be disposed horizontally at the end of said range, the angles of said oppositely located blades relative to said shaft axis being such that during rotation of said shaft said blades will oscillate, respectively, from the nearest to horizontal altitude which they can attain on one side of said axis to the nearest to vertical altitude which they can attain on the other side of said axis such that when one blade is nearest to horizontal the other blade will simultaneously be nearest to vertical, said means for supporting said cylinder being a frame having spaced apart members from which said cylinder is supported, means for supporting one of said members for pivoting, and a loading sensing element for supporting the other of said members.

16. The apparatus as claimed in any of claims 10, 11, 12, 13, 14 or 15 including:

a pair of secondary blades mounted to said shaft and projecting away from said shaft, one of said secondary blades being generally opposite from said first blade and the other being generally opposite from said second blades, said secondary blades being at a lesser radial distance from said shaft than said first and second blades and being disposed in planes which are intersected by said shaft axis at angles other than right angles.

* * * * *